US006575829B2

(12) United States Patent
Coleman et al.

(10) Patent No.: US 6,575,829 B2
(45) Date of Patent: Jun. 10, 2003

(54) METHOD AND APPARATUS FOR GAMING WITH SIMULATION OF TELEPHONE FOR PLAYER INTERACTION

(75) Inventors: James M. Coleman, Reno, NV (US); Dean A. Ehrlich, Elmhurst, IL (US); Michael T. Tessmer, Bozeman, MT (US); Jason R. deGrandmaison, Las Vegas, NV (US)

(73) Assignee: Anchor Gaming, Las Vegas, NV (US)

( * ) Notice: Subject to any disclaimer, the term of this patent is extended or adjusted under 35 U.S.C. 154(b) by 34 days.

(21) Appl. No.: 09/966,339

(22) Filed: Sep. 27, 2001

(65) Prior Publication Data

US 2003/0060258 A1 Mar. 27, 2003

(51) Int. Cl.[7] ..... A63F 9/24
(52) U.S. Cl. ..... 463/20; 463/16; 463/41
(58) Field of Search ..... 463/16, 17, 18, 463/19, 20, 25, 26, 27, 28, 40, 41, 42

(56) References Cited

U.S. PATENT DOCUMENTS 5,608,785 A * 3/1997 Kasday
5,823,874 A 10/1998 Adams
5,848,932 A 12/1998 Adams
5,882,261 A 3/1999 Adams
5,980,384 A 11/1999 Barrie
6,089,976 A 7/2000 Schneider et al.
6,089,978 A 7/2000 Adams
6,113,098 A 9/2000 Adams
6,155,925 A * 12/2000 Giobbi et al.
6,159,097 A * 12/2000 Gura
6,159,098 A * 12/2000 Slomiany et al.
6,168,522 B1 * 1/2001 Walker et al.
6,190,255 B1 * 2/2001 Thomas et al.
6,217,448 B1 * 4/2001 Olsen
6,220,593 B1 * 4/2001 Pierce et al.
6,368,215 B1 * 4/2002 Walker et al.
6,454,649 B1 * 9/2002 Mattice et al.

* cited by examiner

*Primary Examiner*—Michael O'Neill
(74) *Attorney, Agent, or Firm*—Marshall, Gerstein & Borun

(57) ABSTRACT

A bonus event configured for interaction between a player and a gaming machine initiated through a simulated telecommunications link including a telephone handset or similar device such as a speakerphone. The bonus event may be configured as an "incoming" call triggered by some outcome of a primary game on the gaming machine or as an "outgoing" call by a player to the gaming machine. In either instance, the bonus event includes one or more of positive player interactions with the gaming machine, as through a keypad, prior to generation of a bonus award.

75 Claims, 10 Drawing Sheets

METHOD AND APPARATUS FOR GAMING WITH SIMULATION OF TELEPHONE FOR PLAYER INTERACTION

BACKGROUND OF THE INVENTION

1. Field of the Invention

The present invention relates to methods and apparatus for gaming and, more specifically, to a method and apparatus for gaming wherein a telephone simulation is employed to interact with a player in conjunction with a bonus round of play.

2. State of the Art

Gaming machines, commonly termed "slot" machines, have long been a significant facet of the gaming industry. Video versions of gaming machines have become increasingly more popular in recent years. A current, widespread enhancement to conventional single game gaming machines is the addition of a "bonus" or secondary game or event typically enabled if a player achieves at least one selected outcome by play of the underlying base or primary game. Many bonus events are retrofitted as so-called "top boxes" to conventional, single game gaming machines, thus enhancing player appeal with respect to gaming machines already in service.

In many cases, the bonus game is a singular event in that play on the gaming machine changes to the bonus game when a certain base game outcome is achieved, the bonus game then being played to completion. Examples of this type of bonus game, wherein the bonus games are variously configured, are described in U.S. Pat. No. 5,823,874, U.S. Pat. No. 5,848,932, U.S. Pat. No. 5,882,261 and U.S. Pat. No. 6,089,978, all assigned to Anchor Gaming, assignee of the present invention. Progressive games, wherein a portion of wagers is allocated to fund a jackpot, have also been embodied as bonus games. A notably successful example of a so-called linked progressive, wherein a plurality of gaming machines is linked for purposes of contributing to the award from a bonus event won at one of the linked gaming machines, is the Wheel of Fortune bonus game, which is based upon the aforementioned '874 and '932 patents.

In the Wheel of Fortune game, players are notified of the various events in the game through visual indicators such as flashing lights, computer-generated text images in the display, and audible indicators such as theme music playing. Specifically, a player is notified that he or she has won a chance at the bonus event by seeing the symbol appear in the display screen, flashing of a "Spin the Wheel" button on the gaming machine housing and playing of the Wheel of Fortune game theme. When the player pushes the Spin the Wheel button, the bonus wheel spins and sounds of the wheel spinning are generated. When the wheel stops and indicates an award, the sound of audience applause is generated. All of the foregoing elements are intended to enhance the player's gaming experience and to attract other players to the game.

The Wheel of Fortune game has been, and is currently, extremely successful. It is always desirable, however, to continue to improve the individual player's gaming experience to maintain and stimulate interest in gaming through novel approaches to the play of bonus games. For many players, it would be beneficial to prolong and enhance interaction with the bonus game to maintain a high level of entertainment value and to personalize the bonus gaming experience.

BRIEF SUMMARY OF THE INVENTION

The present invention provides prolonged and enhanced player interaction in the context of a bonus event (such term as used herein encompassing, without limitation, bonus games) through use of a telecommunications link (hereinafter "phone link") at the site of the gaming machine and which may be an actual telecommunications component or a simulated one configured as a component of the gaming machine itself In one embodiment, the phone link may be configured as a telephone or a telephone handset; in another embodiment, a speakerphone; in another embodiment, a speakerphone/answering machine and in yet another embodiment, the player is provided an option to select a telephone (or telephone handset), speakerphone or a speakerphone/answering machine. As used herein, the term "phone link" encompasses all of the foregoing structures and variations thereof.

In still another embodiment, a device may be used in conjunction with the gaming machine to dispense noncash items to the player such as, for example, actual prepaid phone cards or tickets or other print media which may be redeemed for prizes of value. It is considered to be especially suitable, while not limiting, that such phone cards or other items be dispensed in association with play of the bonus event.

In one embodiment of the present invention, the bonus event may be configured as an "incoming" call on the phone link from the gaming machine and which is triggered by the random occurrence of a symbol or combination of symbols in the outcome of a primary game, such as a reel-type slot game (electromechanical or electronic), video poker game, video blackjack game, video Keno, video bingo, or any other suitable primary game known in the art. The symbols may be visible or may comprise one or more invisible symbols, or "watermarks", used as an element to trigger the ringing of the phone link to initiate interaction with the player for the bonus event. The incoming call may be initiated by a central controller such as a server such as, for example, a bonus event controller operably coupled to a plurality of gaming machines. It is also contemplated that an incoming call may be initiated by a player and awards made in response thereto in the form of cash, credit, merchandise, etc., or information may be disseminated in response to an incoming call.

In another embodiment of the present invention, the bonus event is configured as an "outgoing" call from the player on the phone link to the gaming machine. In this embodiment, the player accumulates wagering tokens from wins at the primary game, which wagering tokens may be characterized as "call credits" and displayed as a telephone, coin or other symbols on the display of the gaming machine during play of the primary game, such as a reel-type slot game (electromechanical or electronic), video poker game, video blackjack game, video Keno, video bingo, or any other suitable primary game known in the art. The player may trigger the bonus event each time a wagering token is won, or accumulate multiple wagering tokens toward eligibility for higher awards from play in the bonus event initiated at the player's discretion by tendering of one or more of the call credits in the form of elements to initiate bonus play. In one aspect of the embodiment, different numbers of wagering tokens tendered are bracketed for different, progressively higher award ranges. In this embodiment, the player may also be given the option to "cash out" his or her wagering tokens in lieu of playing the bonus event.

In any embodiment, once interaction between the player and the gaming machine has been initiated, a bonus event from a plurality of bonus events may be either chosen by the player or randomly presented to the player.

For example, in the case of an outgoing call bonus event, the player may be presented with a plurality of fictitious "toll free" numbers to select and "call" via a "speed dial" selection initiable, to save time and prevent entry errors, by pressing a single number on a key pad or other player input element of the gaming machine as one would for accessing speed dial selections on a telephone. Once the player makes a selection and the "call" is placed, a comical or other entertaining dialogue is played, optionally in conjunction with a synchronized video animation, and a bonus award is randomly generated and displayed. Optionally, the player may be prompted to push a number or symbol on the key pad, or another player input element, to access the award. In either instance, the amount of the bonus award won is shown on the gaming machine display. Each "speed dial" selection has several possible responses, one of which is randomly chosen for each bonus event. Of course, an incoming call bonus event may be similarly configured, for example, by the player being provided a "voice mail" message over the phone link to "return" a call by speed dial.

An incoming call bonus event or an outgoing call bonus event may also be configured as one of a number of different, well-known telephone experience categories, such as, by way of example, a "radio show" call-in, a "psychic hotline" call-in, a "love line" call-in, and a "joke line" call-in. The telephone experience category for the bonus event may be randomly presented to the player, or the player given the option to choose the category. In either case, once the telephone experience is initiated, the player is given a series of choices as the event progresses through at least two tiers of player interaction until a bonus event outcome is reached and a bonus award is randomly generated and displayed. The bonus award may be conveyed to the player through the phone link and gaming machine display and personalized to the individual player both audibly and visibly through use of player tracking cards, PIN numbers, credit or debit cards, or other suitable techniques known in the art for identifying players.

In yet another embodiment of the invention and one particularly suitable for, although not limited to, bonus events, a visually perceptible representation, such as a video representation, of a partially or completely hidden multidigit telephone number, such as a seven digit "local" number, is displayed. The bonus event is played by guessing each hidden digit (for example, 0 through 9) of the seven digits in the telephone number until the complete telephone number is revealed. A keypad, either on the gaming machine chassis, a portion of a touch screen on the gaming machine, or a keypad specifically associated with the phone link, may be employed to input the player guesses. After each guess of a hidden digit, the player is informed if the guess is correct or, if incorrect, whether the target number to be guessed is higher or lower than the last guess. The guessing process continues until the entire seven-digit telephone number is revealed, in response to which a bonus amount is awarded which correlates to the number of guesses it took to complete the telephone number. The bonus event may also be completed by calling the revealed telephone number to trigger the bonus amount, some portion thereof, or an additional bonus amount, as well as to receive an entertaining or congratulatory message. It is further contemplated that one or more additional telephone-associated symbols on the keypad such as "*" and "#" may be used as wild symbols to complete the digits of the telephone number. A player may be provided with one or more such wild symbols to play as part of the bonus event, such symbols may be awarded during play of a primary or base game which leads to the bonus event, or a player may be permitted to purchase a selected number of wild symbols at the commencement of the bonus event or during play thereof With any of the foregoing approaches to the bonus event, a player may also be provided the option, at the conclusion of a bonus event, to play for "double or nothing" and wager the bonus award in a new bonus event round.

It is also contemplated that the game of the present invention may be implemented with the bank of networked gaming machines and further contemplated that the game may be implemented as a linked progressive game among a plurality of networked gaming machines at a single or plurality of different sites.

BRIEF DESCRIPTION OF THE SEVERAL VIEWS OF THE DRAWINGS

In the drawings, which illustrate what is currently considered to be the best mode out the invention.

DETAILED DESCRIPTION OF THE INVENTION

Figure 1:
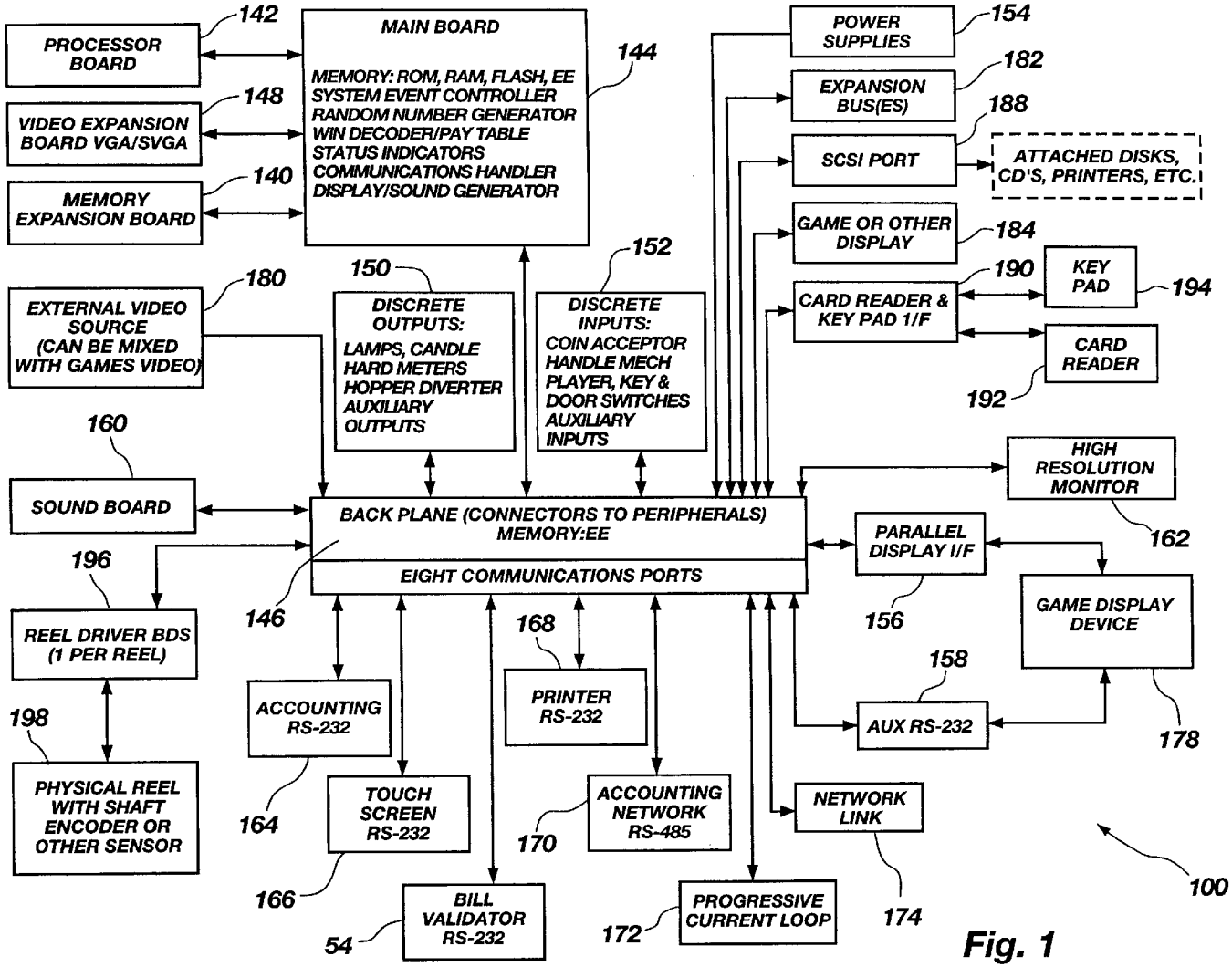
FIG. 1 is a schematic of an exemplary gaming machine architecture suitable for use in implementing the present invention.

In use and operation, and referring to FIG. 1, the gaming device 100 includes a main board 144 and a back plane 146 integrally or separately formed. Memory expansion board 140 as well as processor board 142 including a graphics system processor and video expansion board VGA/SVGA 148 are operably coupled to the main board 144. The main board 144 preferably includes memory in the form of ROM, RAM, flash memory and EEPROM (electrically erasable programmable read only memory). The ROM includes the EEPROM. In addition, the main board 144 includes a system event controller, a random number generator, a win decoder/pay table, status indicators, a communications handler and a display/sound generator.

The main board 144 is operably coupled to the back plane 146 which includes memory, preferably in the form of an EEPROM, and connectors to connect to peripherals. Furthermore, the back plane 146 provides a plurality of communication ports for communicating with external peripherals. The back plane 146 provides the coupling between discrete inputs 152 and main board 144. Typical examples of elements which provide discrete inputs are coin acceptors, game buttons, mechanical hand levers, key and door switches and other auxiliary inputs. Furthermore, the back plane 146 provides the coupling between discrete outputs 150 and main board 144. Typically, elements that provide discrete outputs are in the form of lamps, hard meters, hoppers, diverters and other auxiliary outputs.

The back plane 146 also provides connectors for at least one power supply 154 for supplying power for the processor, board 142 a parallel display interface "PDI" 156 and a serial interface 158. In addition, the back plane 146 also provides connectors for a sound board 160 and a high-resolution monitor 162 as well as the parallel display interface 156 operably coupled to at least one game display device 178. Furthermore, the back plane 146 includes communication ports for operably coupling and communicating with an RS-232 accounting link 164, a touch screen 166 (which may also serve as a game display device), a bill validator 54 incorporated in a currency (bill) acceptor, a printer 168, an RS-485 link to accounting network 170, a progressive current loop 172 and a network link 174.

The back plane 146 optionally includes connectors for external video sources 180, expansion buses 182, game or other displays 184, an SCSI port 188 and an interface 190 for at least one card reader 192 (debit/credit, player card, etc.) and key pad 194. The back plane 146 also preferably includes means for coupling a plurality of reel driver boards 196 (one per reel) which drives physical game reels 198 with a shaft encoder or other sensor means to the processor board 142 and main board 144. Of course, the reels may be similarly implemented electronically by display as video images, technology for such an approach being well known and widely employed in the art. In such an instance, reel driver boards 196 and physical game reels 198 with associated hardware are eliminated and the game outcome generated by the random number generator on main board 144 is directly displayed on a video game display 184 and, optionally, on a separate game device display 178, as known in the art. Other gaming machine configurations for play of different wagering games such as video poker games, video blackjack games, video Keno, video bingo or any other suitable primary games are equally well known in the art.

It will also be understood and appreciated by those of ordinary skill in the art that selected components of gaming device 100 may be duplicated for play of a bonus game or event in accordance with the present invention, in that at least a separate board with a second random number generator may be employed, with associated peripherals and links thereto, for play of the bonus game. In the conventional situation wherein the bonus game of the present invention may be operably coupled as a "top box" or otherwise associated with a conventional, existing gaming machine configured for play of a base game, many of the components illustrated in FIG. 1 and described with respect thereto will be duplicated, including separate software and associated memory for conducting play of the bonus game with associated pay tables for the bonus awards.

Figure 2:
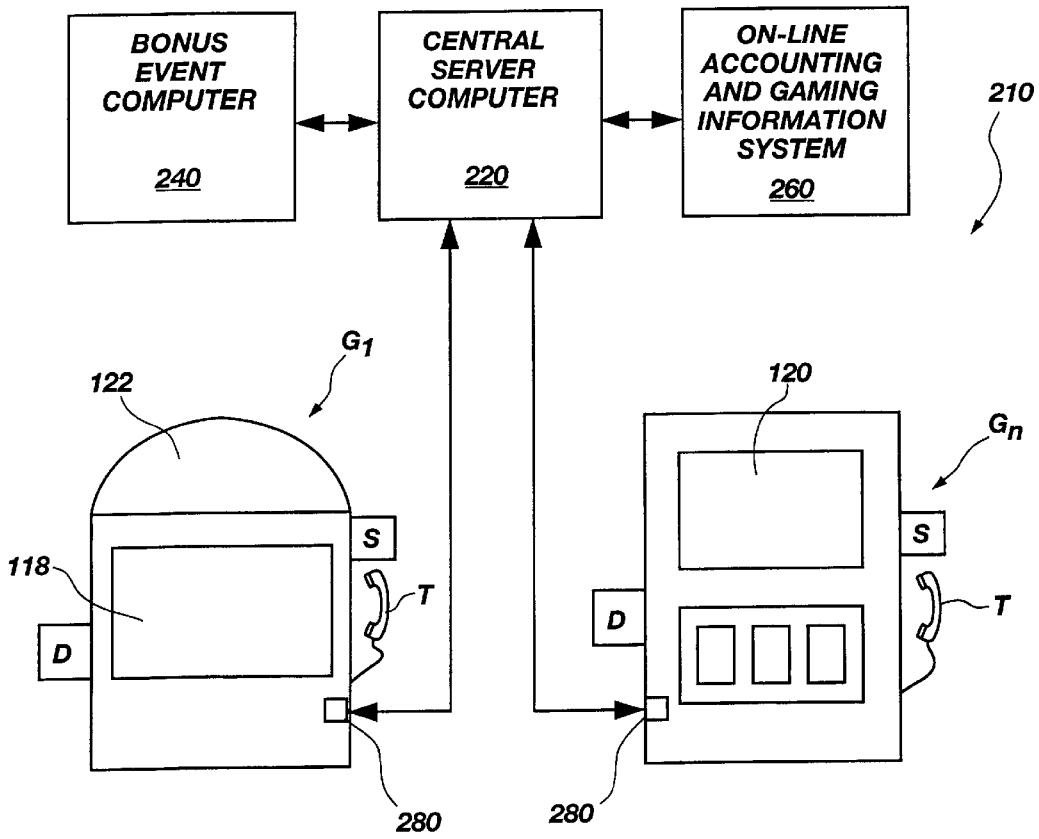
FIG. 2 is a schematic of a plurality of networked gaming machines as may be employed to implement the present invention, optionally in the form of a single site linked progressive configuration.

In implementation of the present invention, the gaming machines offering play of the bonus event of the present invention may be deployed, as schematically depicted in FIG. 2, in a gaming network 210 that includes a central server computer 220 operably coupled to a plurality of gaming machines $G_1$, $G_2$ . . . $G_n$ which may include both electronic and reel-type game machines. It is notable that, unless the gaming network 210 is configured for progressive play, a variety of different makes of gaming machines $G_1$, $G_2$ . . . $G_n$ offering widely different games may be incorporated in gaming network 210, since the bonus event operates independently of the primary game on each gaming machine. The central server computer 220 automatically interacts with a plurality of gaming machines $G_1$, $G_2$ . . . $G_n$ to activate an incoming call or outgoing call bonus event.

More specifically, and again referring to FIGS. 1 and 2, the gaming network 210 includes a central server computer 220, a bonus event computer 240 and a plurality of gaming machines $G_1$, $G_2$ . . . $G_n$. Each gaming machine $G_1$, $G_2$ . . . $G_n$ includes a controller assembly 280 operably coupled to the central server computer 220 and is comprised of a controller unit designed to monitor multiple signals from each individual gaming machine $G_1$, $G_2$ . . . $G_n$. In addition, the controller assembly 280 includes a network interface board fitted with appropriate electronics for each specific make and model of each individual gaming machine $G_1$, $G_2$ . . . $G_n$.

Referring to FIG. 2, in electronic video games, the central server computer 220 is operably coupled to at least one video game display element 118 as shown at the left-hand side of FIG. 2 and sequesters a portion of the video game display element 118 for displaying video attract sequences to attract potential players. Video game display element 118 may be used for display of both the primary and bonus games. Where the gaming network 210 includes reel-type gaming machines $G_1$, $G_2$ . . . $G_n$, as shown at the right-hand side of FIG. 2, the central server computer 220 may be operably coupled to at least one active display element 120 so that potential players receive a clear indication of attract sequences and the active display element 120 may be used as a video display for the bonus game. As shown at the left-hand side of FIG. 2, the gaming machines $G_1$, $G_2$ . . . $G_n$ may also be provided with a second video display 122 as an alternative to sequestering a portion of the video game display 118 for displaying video attract sequences and the bonus game. In addition, the central server computer 220 may include sound-generating hardware and software for producing attractive sounds orchestrated with the video attract sequences at each of gaming machines $G_1$, $G_2$ . . . $G_n$ if such is not already incorporated therein. The games support input and output between the player and the game for such devices as heads up display, joystick, keyboard, mouse and data glove via interface modules connected through the expansion bus or buses 182 and SCSI port 188.

The attractive multimedia video displays and dynamic sounds may be provided by the central server computer 220 by using multimedia extensions to allow gaming machines $G_1$, $G_2$ . . . $G_n$ to display full-motion video animation with sound to attract players to the machines. During idle periods, the gaming machines $G_1$, $G_2$ . . . $G_n$ preferably display a sequence of attraction messages in sight and sound. The videos may also be used to market specific areas of the casino and may be customized to any informational needs.

Furthermore, the gaming network 210 includes bonus event computer 240 operably coupled to the central server computer 220 for scheduling bonus parameters such as the type of bonus game, pay tables and players. Preferably, the gaming network 210 further includes a real-time or on-line accounting and gaming information system 260 operably coupled to the central server computer 220. The accounting and gaming information system 260 includes a player database for storing player profiles, a player tracking module for tracking players and a pit, cage and credit system for providing automated casino transactions.

Figure 3:
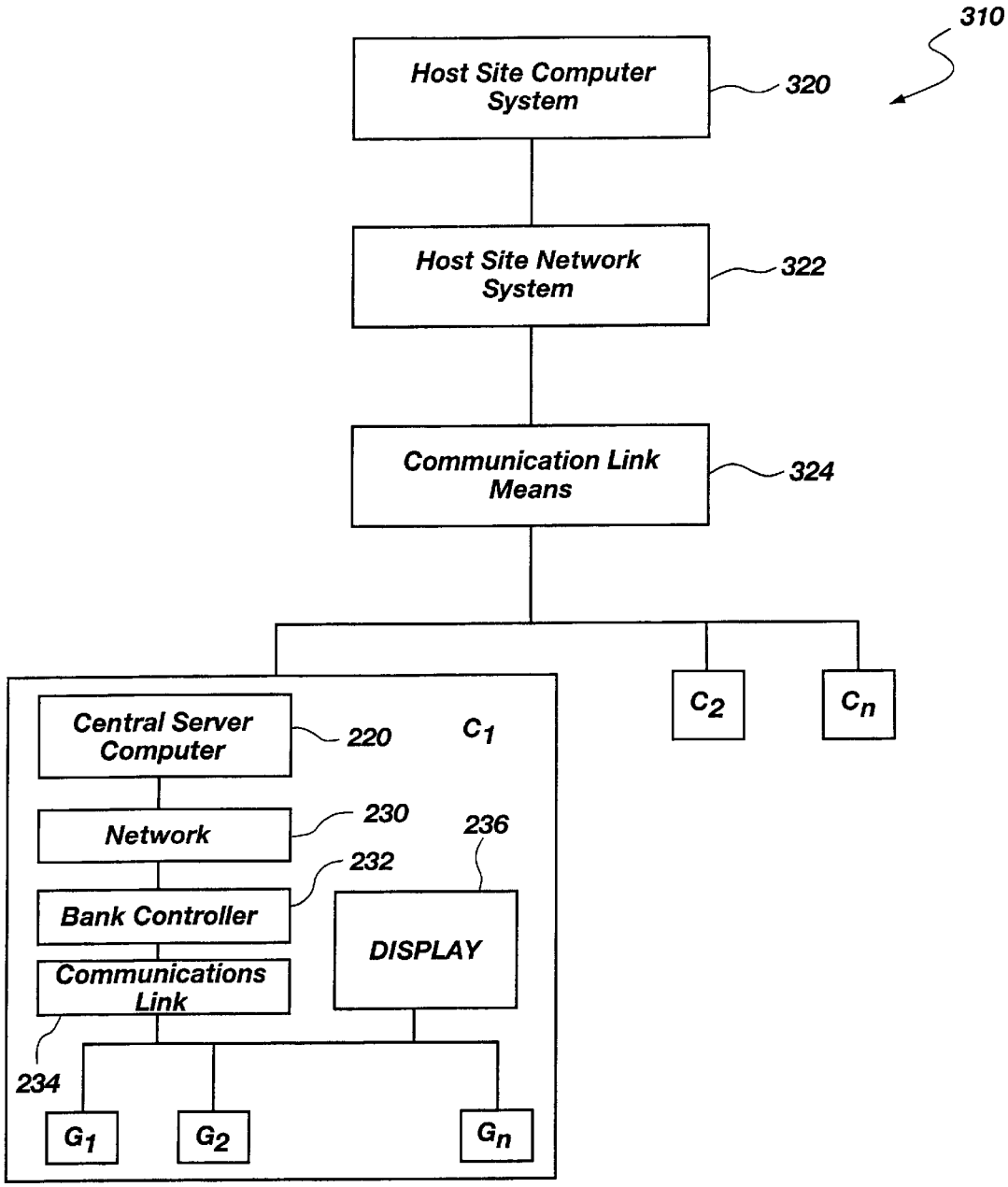
FIG. 3 is a schematic of a bonus gaming system as may be employed to implement the present invention in a multi-site configuration, which may comprise a linked progressive configuration.

As previously implied, a bank of gaming machines $G_1$, $G_2$ . . . $G_n$ may be networked together in a progressive configuration, as known in the art, wherein a portion of each wager to initiate a primary game may be allocated to bonus eventawards. In addition, and referring to FIG. 3, a host site computer 320 is coupled to a plurality of the central server computers 220 at a variety of remote gaming sites $C_1$, $C_2$ . . . $C_n$ for providing a multisite linked progressive automated bonus gaming system 310.

Preferably, the host site computer 320 will be maintained for the overall operation and control of the system 310. The host site computer 320 includes a computer network 322 and a communication link 324 provided with a high-speed, secure modem link for each individual casino site $C_1, C_2 \ldots C_n$.

Each casino site $C_1, C_2 \ldots C_n$ includes the central server computer 220 provided with a network controller 230 which includes a high-speed modem operably coupled thereto. Bi-directional communication between the host site computer 320 and each casino site central server computer 220 is accomplished by the set of modems transferring data over communication link 324.

A network controller 230, a bank controller 232 and a communication link 234 are interposed between each central server computer 220 and the plurality of attached gaming machines at each casino site $C_1, C_2 \ldots C_n$. In addition, the network controller 230, the bank controller 232 and the communication link 234 may optionally be interposed between each central server computer 220 and a separate display 236 at each casino site $C_1, C_2 \ldots C_n$. However, the system 310 may include hardware and software to loop back data for in-machine meter displays to communicate with bonus event award insert areas on gaming machines $G_1$, $G2 \ldots G_n$.

Figure 4:
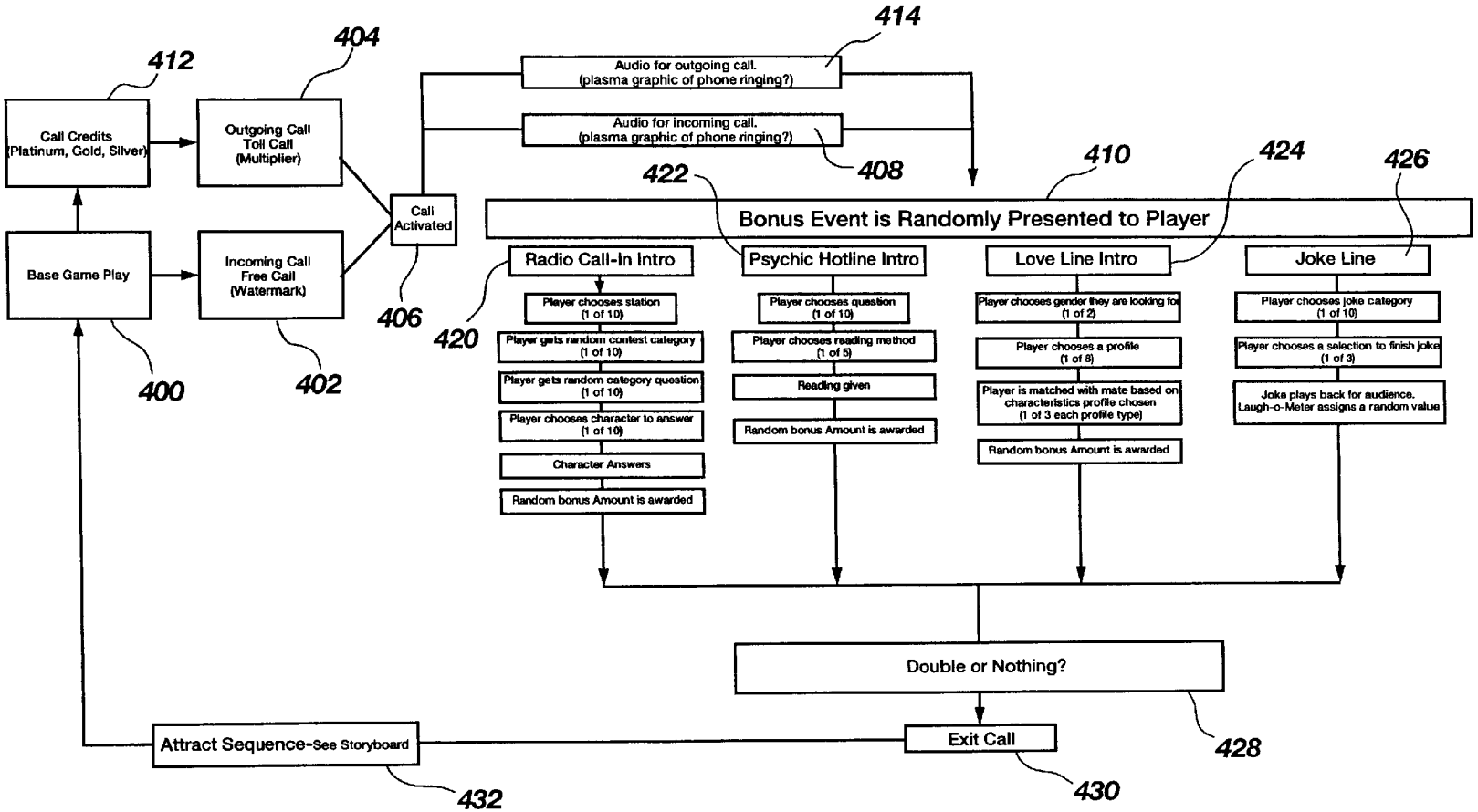
FIG. 4 is a flow chart of one exemplary implementation of an embodiment of the game of the present invention.

Referring to FIG. 4, a flow chart of an exemplary sequence of events for incoming and outgoing call bonus events in accordance with the present invention is depicted. As depicted thereon, base game play 400 may sequence into either an incoming call 402 or outgoing call 404 as a bonus event. Either an incoming call 402, an outgoing call 404 or both may be employed, as desired.

In the case of an incoming call 402, the call may be characterized as a "free" call as it is triggered by the occurrence of one or more watermarks, as previously noted, associated with an outcome of base game 400. If triggered, a call is activated at 406 and an audio for an incoming call is activated at 408, optionally accompanied by a display graphic, such as a plasma display, of a phone ringing. A bonus event is then randomly presented to the player at 410. Alternatively, the player may be given the option to choose a bonus event from the plurality offered.

In the case of an outgoing call 404, the call may be characterized as a "toll" call. To place the toll call, the player must have previously accumulated a number of call credits 412 during play of the base game to pay for the toll call. Call credits may be accumulated so as to enable the player to play the bonus event for larger awards. For example, call credits may be bracketed into a plurality of award ranges, with the wagering of more accumulated call credits (for example, in the form of phone symbols) required for higher awards from play of the bonus event. For example, the brackets may be characterized as "Bronze Club," "Gold Club" and "Platinum Club," as follows:

| Phone Symbols | Level | Range of Pays |
|---|---|---|
| 11+ | Platinum Club | 1,000 to 10,000 coins |
| 5–10 | Gold Club | 100–999 coins |
| 1–4 | Bronze Club | 10–99 coins |

The number of phone symbols accumulated over time is displayed on a display or display segment on a gaming machine G as a player plays the base game.

When a player elects to place a toll call and play the bonus event, he or she places the call by tendering a number of call credits to activate the call at 406. In the case of Gold Club and Platinum Club play, the bonus event may also be characterized as incorporating a multiplier for a potential bonus award. An audio for an outgoing call is activated at 414, optionally accompanied by a display graphic, such as a plasma display, of a phone ringing. A bonus event is then randomly presented to the player at 410, as in the instance of an incoming call.

In this embodiment, in the case of both incoming and outgoing calls, one of four bonus events is offered to the player: a Radio Call-In 420, a Psychic Hotline 422, a Love Line 424 and a Joke Line 426. In each instance, a sequence of events occurs as set forth in FIG. 4, with a plurality of positive player interactions with the gaming machine during each bonus event. In each instance, the bonus event concludes with an award of a random bonus amount. Expanded event formats for each of bonus events 420 through 426 are respectively set forth in FIGS. 5 through 8. At the conclusion of a bonus event, the player may be given the opportunity at 428 to play for double or nothing. At the conclusion of a bonus event, the call is exited at 430, and an attract sequence associated with the bonus game is displayed on each gaming machine G at 432.

Figure 5:
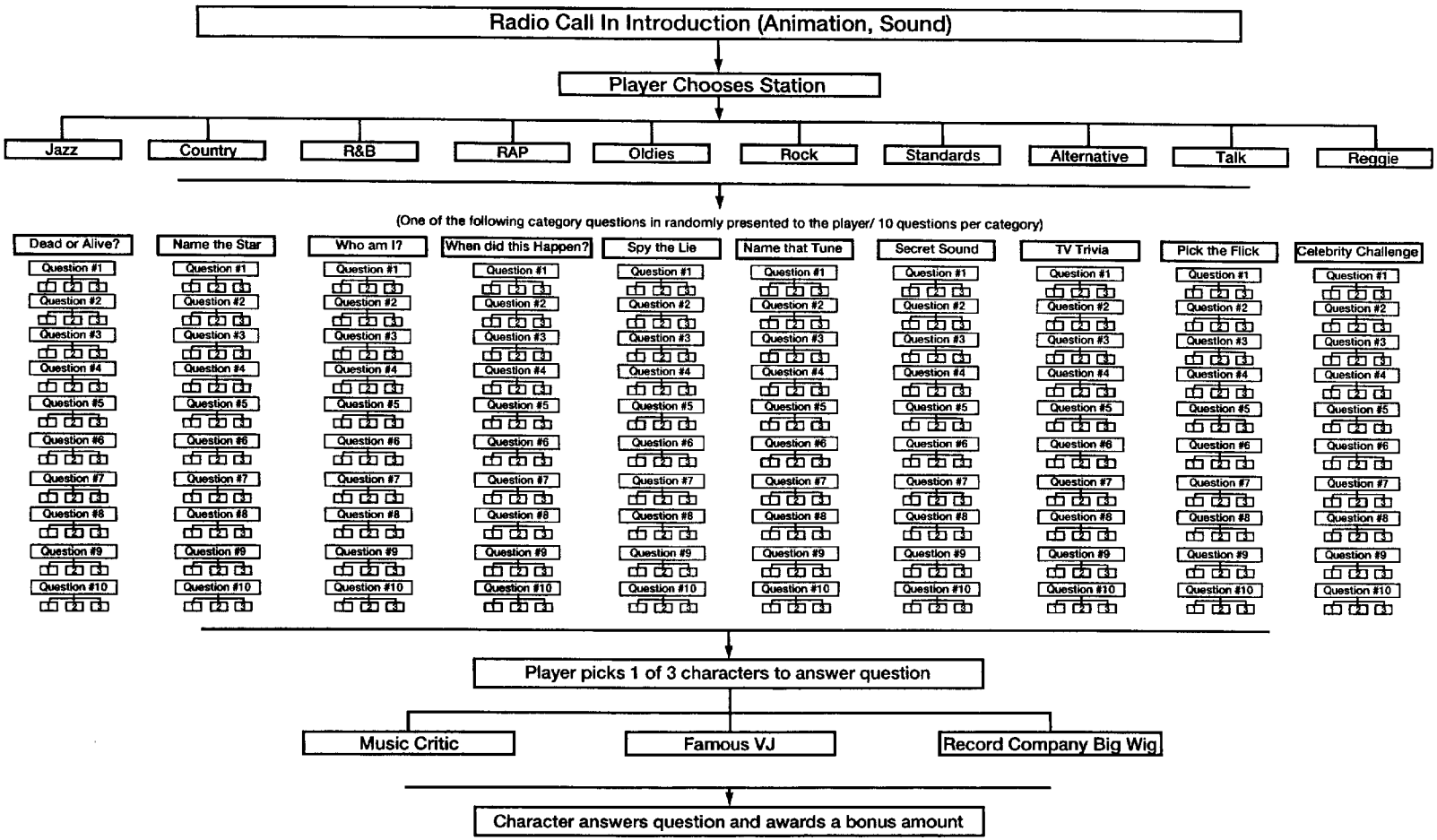
FIGS. 5 through 8 respectively comprise expanded event formats for each of four (4) exemplary bonus events for the embodiment of FIG. 4.

For Radio Call-In bonus event 420, FIG. 5 depicts the occurrence of a Radio Call-In introduction with animation and sound, followed by the opportunity for the player to choose one of ten radio stations, each identified by their broadcast format (Jazz, Country, etc.). Once the broadcast format is chosen, the player receives a random contest category (Dead or Alive, Name that Star!, etc.) and one of a number of questions from that category is randomly presented to the player. The player then picks one of three characters to answer the question: A Music Critic, a Famous VJ and a Record Company Big Wig. The chosen character is then depicted as an animated video image and answers the question from a plurality of choices with associated, synchronized sound and a random bonus amount is awarded.

Figure 6:
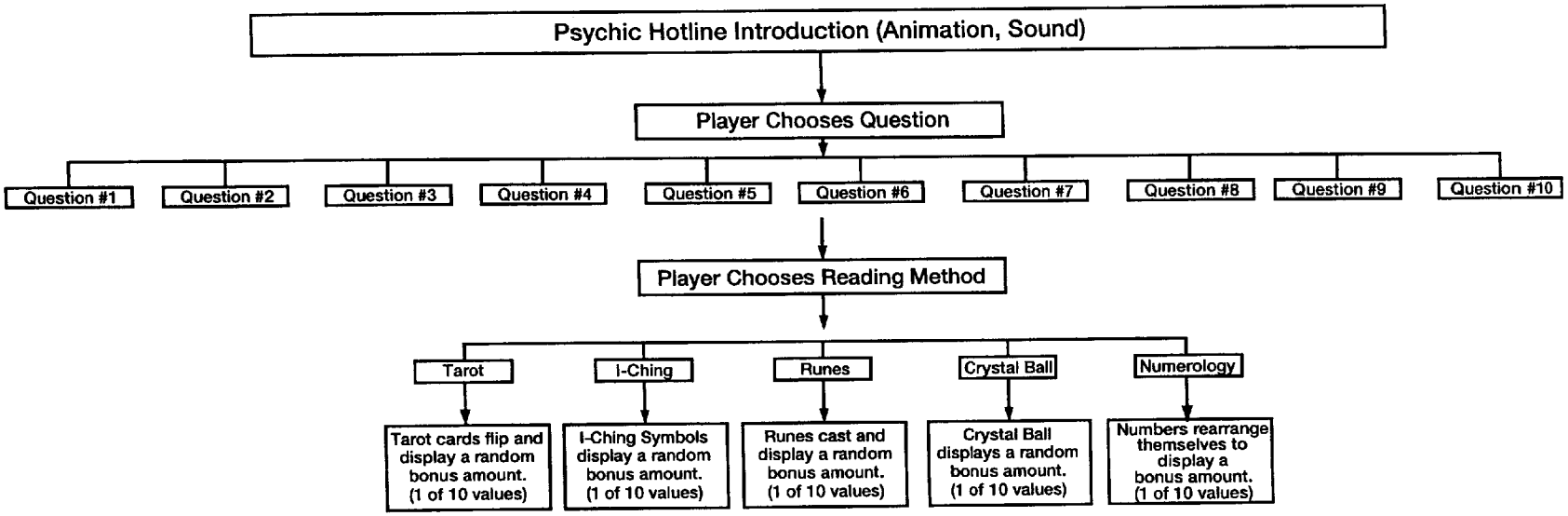

For Psychic Hotline bonus event 422, FIG. 6 depicts the occurrence of a Psychic Hotline introduction with animation and sound, followed by the opportunity for the player to choose one of ten questions for "Zelda" the "psychic" to answer. Once the question is chosen, the player chooses a reading method (Tarot, I-Ching, etc.), a reading is given by a video image of Zelda with associated, synchronized sound and a random bonus amount is awarded from a plurality of values.

Figure 7:
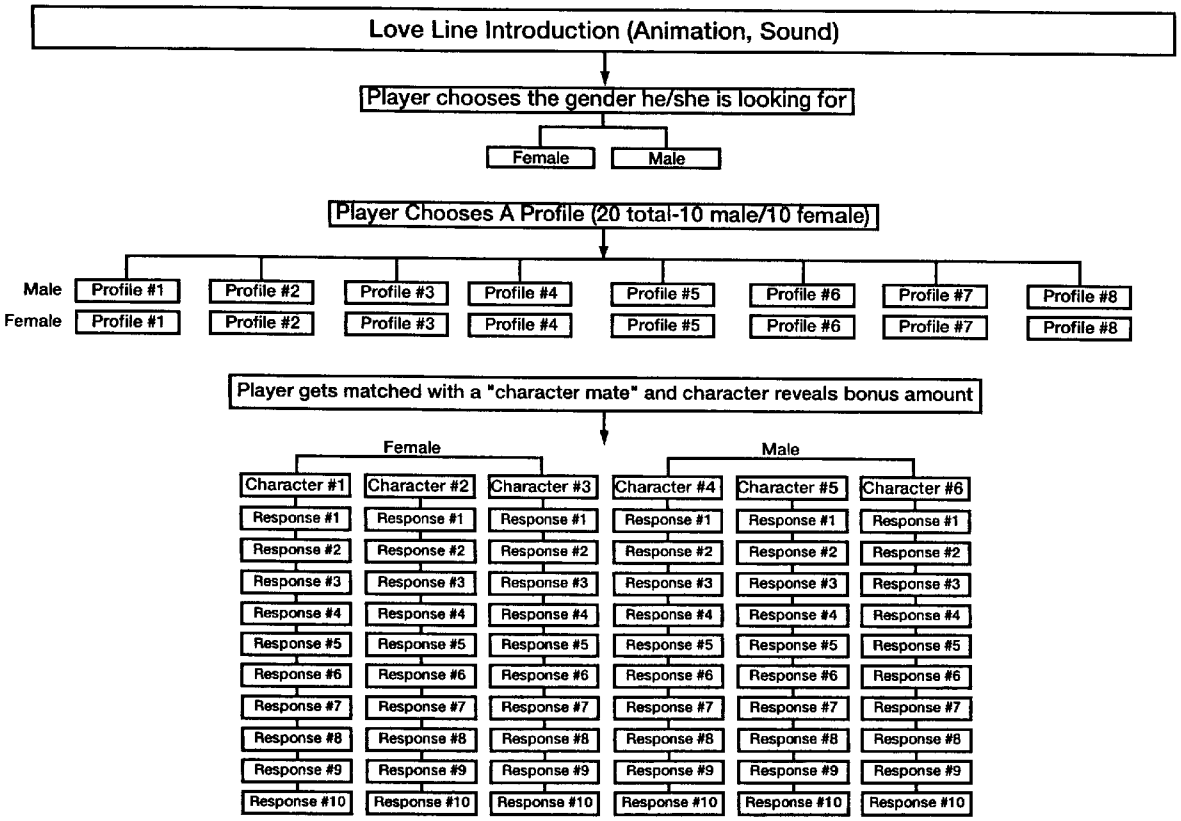

For Love Line bonus event 424, FIG. 7 depicts the occurrence of a Love Line introduction with animation and sound, followed by the opportunity for the player to choose the gender he or she is looking for. The player then chooses a profile from one of ten profiles available for each gender and is "matched" with a mate based on the profile chosen. The match appears as a video image, which introduces himself or herself in the form of a response from a plurality of responses to the selected profile, and a random bonus amount is awarded.

Figure 8:
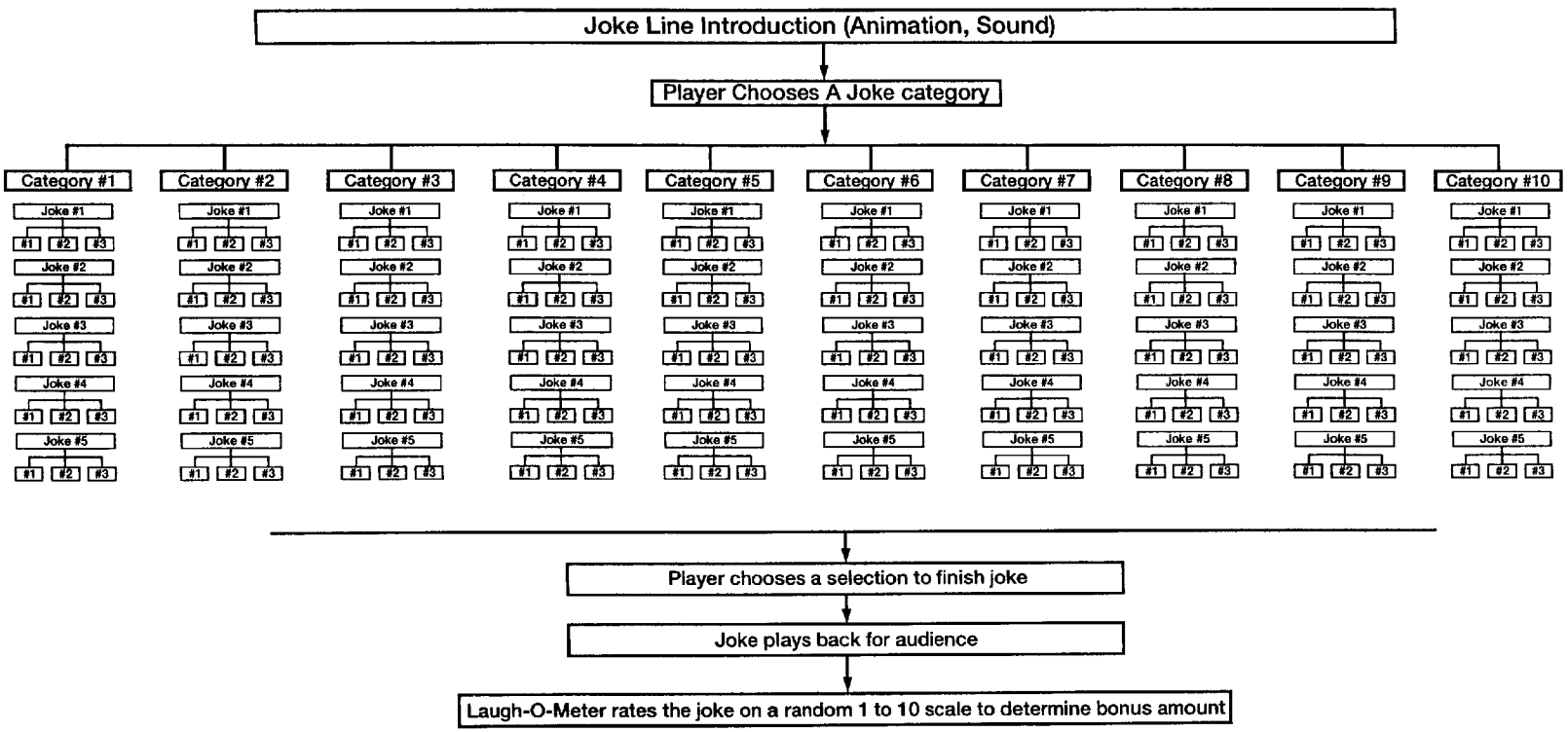

For Joke Line bonus event 426, FIG. 8 depicts the occurrence of a Joke Line introduction with animation and sound, followed by the opportunity for the player to choose one often joke categories. A joke portion from a plurality of jokes in the joke category chosen randomly appears on the video display, and the player also chooses a selection from among three alternatives as a punch line or concluding portion to finish the joke. The complete joke, with punch line, is depicted and played back for an "audience" depicted on the video display and a "Laugh-O-Meter" also depicted on the display rates the joke randomly on a 1 to 10 scale to determine the bonus amount awarded.

Figure 9:
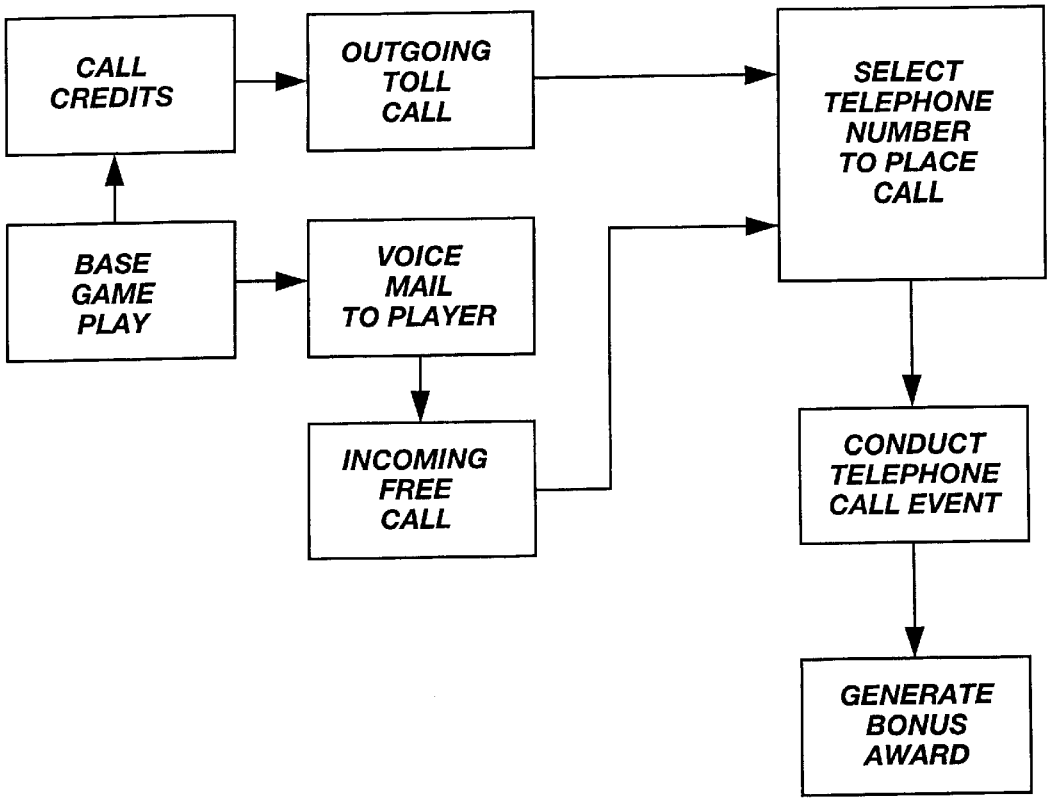
FIG. 9 is a flow chart of another exemplary implementation of an embodiment of the game of the present invention.

In another embodiment, either an incoming or outgoing call bonus event may be configured as a "Speed Dial" opportunity. As depicted in FIG. 9, the call may be initiated by the player as an outgoing "toll" call requiring the tender of one or more telephone symbols accumulated during play of the base game, as described above. Alternatively, the occurrence of a watermark or combination of watermarks during play of the base game may result in a "voice mail" message being initiated requiring the player to "call back" for the bonus event.

In the case of an outgoing call, the player may be presented with a plurality of fictitious telephone numbers (1-900-HOT STUF, 1-777-BIG WINS, 1-888-GUD LUCK, etc.,) to select and "call" via a "speed dial" selection initiable, to save time and prevent entry errors, by pressing a single number on a key pad or other player input element of the gaming machine as one would for accessing speed dial selections on a telephone. Once the player makes a selection and the "toll call" is placed, a comical or other entertaining dialogue is played, optionally in conjunction with a synchronized video animation, and a bonus award is randomly generated and displayed. Optionally, in the course of the telephone call event, the player may be prompted to push a number or symbol on the key pad, or another player input element, to access the award. In either instance, the amount of the bonus award won is shown on the gaming machine display. Each "speed dial" selection has several possible responses, one of which is randomly chosen for each bonus event.

An incoming call bonus event may be similarly configured, for example, by the player being provided a random "voice mail" message over the phone link and depicted on the video display to "return" a call to one of the fictitious numbers (in this instance, a "toll free" number) by speed dial. The player may be required to enter the number on the keypad or a key on the keypad or another player input element may be used to initiate an automatic call back "speed dial" of the number to further progress of the bonus event.

As depicted in FIG. 2, a phone link in the form of a telephone handset T (the term including an entire telephone assembly or components thereof, such as a handset) or a speakerphone S (the term including a speakerphone/answering machine) may be associated with each gaming machine $G_1$, $G_2$ . . . $G_n$. The player may be given the opportunity to use the speakerphone S or telephone handset T during play of the base game, or at the inception of a bonus event.

The phone link may also be used to notify the player of the bonus award achieved at the conclusion of a bonus event. If player tracking cards or other means for identifying the player are employed, the award message may be customized and personalized for the player (e.g., "Marge, you've just won FIVE HUNDRED dollars!") through the phone link as well as on the video display of the gaming machine. Optionally, the telephone handset T may comprise a portion of a touch screen having a telephone handset image thereon, and a speakerphone S in the form of the speakers of the gaming machine used for other audio employed to convey messages to the player.

Once a bonus award is made, it is logged onto a bonus credit meter or a consolidated award credit meter to either be retrieved by the player or used for further wagers, all as known in the art. If the payout is sufficiently large to require an IRS form W2G, the gaming machine preferably locks up and a signal is sent to central server computer 220 for reconciliation of the award. In the context of a linked progressive implementation of the game of the present invention, the award will, of course, be greatly enhanced and communication with gaming system 310 initiated as well.

Figure 10:
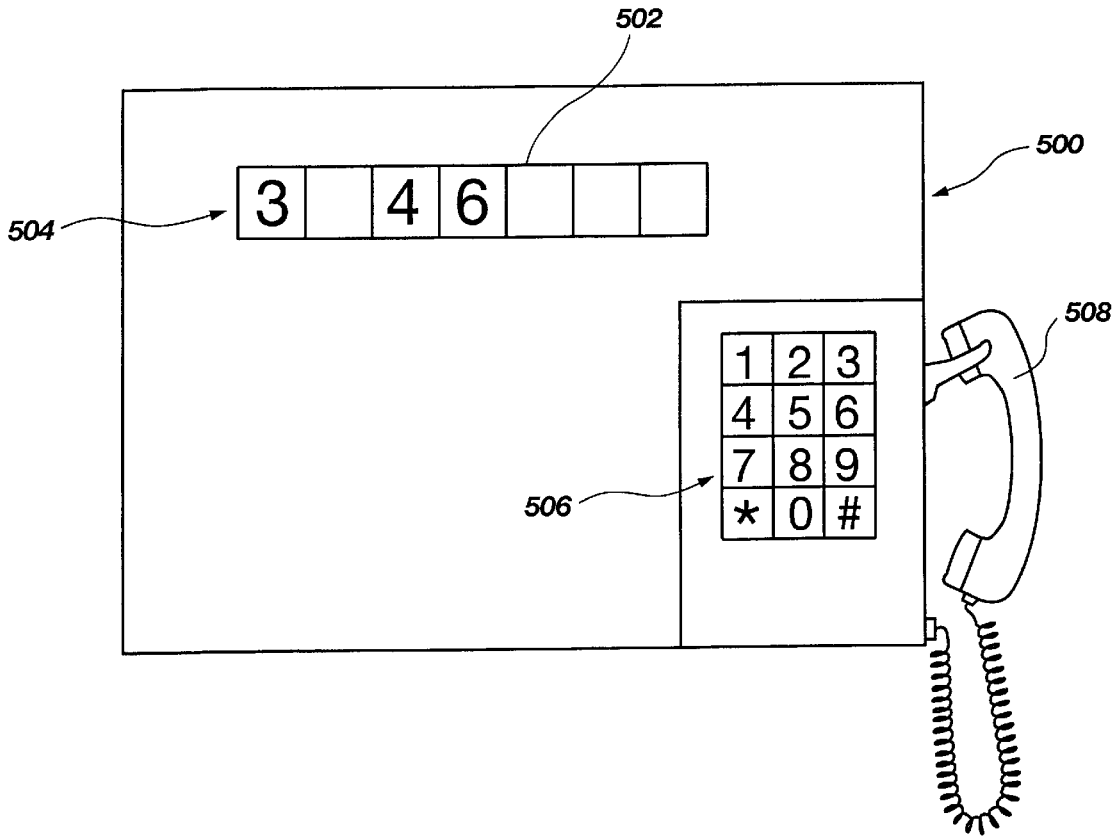
FIG. 10 is a schematic illustration of a portion of a gaming machine configured for play of a further embodiment of the present invention.

Yet another embodiment of the invention and one particularly suitable for, although not limited to, bonus events is schematically illustrated in FIG. 10. Gaming machine 500, configured as a "top box" for a bonus event, employs a visually perceptible representation, such as a video representation on video display 502, of a partially or completely unknown and hidden multidigit telephone number 504, such as a seven digit "local" number. In FIG. 10, three of the seven digits are displayed, while four others remain hidden and still unknown. The bonus event may be configured to require that all seven digits be guessed, or only one or more, but less than all. Moreover, the base or primary game associated with the bonus event may reward successful play by providing one or more of the numbers at the inception of the bonus event. The bonus event is played by guessing each hidden digit (for example, 0 through 9) of the seven digits in the telephone number 504 until the complete telephone number 504 is revealed. A keypad, either on the gaming machine housing (such as keypad 194 described in the context of FIG. 1), a portion of a touch screen on the gaming machine (such as touch screen 166 described in the context of FIG. 1), or a keypad 506 specifically associated with an exemplary phone link 508, as shown in FIG. 10, may be employed to input the player guesses for each digit. After each guess of a hidden digit, the player is informed if the guess is correct or, if incorrect, whether the "target" digit to be guessed is higher or lower than the last guess. The guessing process continues until the entire seven digit telephone number 504 is revealed, in response to which a bonus amount is awarded which correlates to the number of guesses it took to complete the telephone number. The bonus event may also be completed by calling the revealed telephone number on phone link 508 to trigger the bonus amount, some portion thereof, or an additional bonus amount, as well as to receive an entertaining or congratulatory message. It is further contemplated that one or more additional telephone-associated symbols on the keypad such as "*" and "#" may be used as wild symbols to complete the digits of the telephone number. A player may be provided with one or more such wild symbols to play as part of the bonus event, such symbols may be awarded during play of a primary or base game which leads to the bonus event, or a player may be permitted to purchase a selected number of wild symbols at the commencement of the bonus event or during play thereof.

In a further implementation of the present invention, the phone link may be configured for optional use by a player to obtain more detailed information on bonus play including information on how the player can play the bonus event immediately, to place a call to another player at another gaming machine, to place a call to another location at the casino such as a guest room or restaurant, to place a call through an outside line to a location remote from the casino, to obtain information about casino shows, restaurants, etc. or to connect to a casino telephone operator. As such, it is contemplated that the phone link may be configured as an actual telecommunications link in addition to its utility with the game of the present invention.

As yet another implementation of the present invention, the call credits may be accumulated for use in buying time for making one or more "toll calls" on the telephone link, and the more calls completed by the player, the higher the bonus award achieved. Each call may feature a voice message to which the player is enabled to respond through manual input to the gaming machine on, for example, the keypad.

In still another embodiment, a dispensing device D (see FIG. 2) may be used in conjunction with the gaming machine to dispense noncash items to the player such as, for example, actual prepaid phone cards or tickets or other print media which may be redeemed for prizes of value. It is considered to be especially suitable, while not limiting, that such phone cards or other items be dispensed in association with play of the bonus event. The dispensing device D may be configured and operated in accordance with the teachings of U.S. Pat. No. 6,113,098, assigned to the assignee of the present invention and the disclosure of which is hereby incorporated herein by reference.

While the present invention has been disclosed herein in terms of certain exemplary embodiments, those of ordinary skill in the art will recognize and appreciate that it is not so limited. Many additions, deletions and modifications to the disclosed embodiments may be effected without departing from the scope of the invention. Moreover, features from one embodiment may be combined with features from another embodiment. The scope of the present invention is only to be limited by the claims which follow.

What is claimed is:

1. A gaming device for playing games of chance, comprising:

a gaming unit configured for operation in a first mode for play of a primary game and in a second mode for play of a bonus game;

wherein the gaming unit when enabled in the first mode is operable to randomly generate and display at least one combination of symbols selected from a plurality of symbols during play of the primary game, at least some combinations of symbols comprising winning outcomes for the primary game and at least one outcome of the primary game comprising at least one element to enable operation of the gaming unit in the second mode for play of a bonus game;

wherein the game unit when enabled in the second mode is operable to communicate with a player to provide the player with an opportunity to play one of a plurality of bonus games and to make and communicate at least two choices associated with play of the one bonus game to the gaming unit, each of the at least two choices being available from a plurality of choices, and the gaming unit is operable in the second mode to randomly generate an outcome for the bonus game subsequent to the communication of the at least two choices;

wherein each of the plurality of bonus games is configured as a simulation of a telephone call event and the gaming unit is configured to communicate with the player in association with play of each bonus game of the plurality through a phone link operably coupled to the gaming unit.

2. The gaming device of claim 1, wherein the at least one outcome of the primary game comprising at least one element enables immediate operation of the gaming unit in the second mode for play of the bonus game.

3. The gaming device of claim 2, wherein the at least one element comprises a watermark associated with at least one symbol of a randomly generated and displayed combination of symbols.

4. The gaming device of claim 1, wherein the at least one element comprises at least one credit for enabling operation of the gaming unit in the second mode for play of the bonus game at the player's discretion.

5. The gaming device of claim 1, wherein the gaming unit is configured to permit accumulation of a plurality of credits for enabling operation of the gaming unit in the second mode for play of the bonus game at the player's discretion.

6. The gaming device of claim 5, wherein the gaming unit is configured to permit tendering of at least two different numbers of credits for play of the bonus game for at least two different bonus awards.

7. The gaming device of claim 5, wherein the gaming unit is configured to permit tendering of differing numbers of credits, each of the differing numbers of credits being within at least two different, non-overlapping ranges, for play of the bonus game for bonus awards within at least two different ranges of bonus awards, each of the at least two different ranges of bonus awards being non-overlapping.

8. The gaming device of claim 1, wherein the gaming unit is configured, when enabled for operation in the second mode, to initiate communication with the player relating to a bonus game through the phone link.

9. The gaming device of claim 8, wherein the gaming unit is configured, when enabled for operation in the second mode, to permit the player to choose one bonus game of the plurality for play.

10. The gaming device of claim 8, wherein the gaming unit is configured, when enabled for operation in the second mode, to randomly assign one of the plurality of bonus games for play.

11. The gaming device of claim 1, wherein each simulation of a telephone call event presents the player with the at least two choices, and the gaming unit is configured to receive each of the at least two choices in the form of manual input by the player to the gaming unit.

12. The gaming device of claim 11, wherein at least one of the plurality of bonus games is configured as a Radio Call-In telephone call event, a Psychic Hotline telephone call event, a Love Line telephone call event, or a Joke Line telephone call event.

13. The gaming device of claim 12, wherein the Radio Call-In telephone call event is configured to operate in a manner comprising:

providing a choice to the player of a plurality of radio stations, each exhibiting a different program format;

responsive to a choice of a radio station from the plurality, randomly assigning a contest category from a plurality of contest categories;

randomly providing a question within the assigned contest category from a plurality of questions;

providing a choice to the player of a plurality of characters to answer the provided question;

responsive to a choice of character, initiating an answer to the provided question by the character; and randomly generating a bonus award.

14. The gaming device of claim 12, wherein the Psychic Hotline telephone call event is configured to operate in a manner comprising:

providing a choice to the player of a plurality of different questions for a reading by a psychic;

responsive to the choice of a question from the plurality, providing a choice to the player of a plurality of different methods for the reading;

responsive to the choice of a reading method, providing a reading responsive to the chosen question; and randomly generating a bonus award.

15. The gaming device of claim 12, wherein the Love Line telephone call event is configured to operate in a manner comprising:

providing to the player a choice of gender for a love interest;

responsive to the choice of a gender by the player, providing the player with a choice of personal profiles each exhibiting at least some different characteristics;

responsive to the choice of a personal profile by the player, matching the player with a love interest in relation to the exhibited characteristics of the chosen personal profile; and randomly generating a bonus award.

16. The gaming device of claim 12, wherein the Joke Line telephone call event is configured to operate in a manner comprising:

providing to the player a plurality of joke categories from which to choose;

responsive to the choice of a joke category from the plurality by the player, providing an initial portion of a joke and providing to the player a plurality of concluding portions for the joke from which to choose;

responsive to the choice of a concluding portion for the joke by the player, playing back the joke as completed with the chosen concluding portion;

randomly assigning a Laugh-O-Meter value to the completed joke; and generating a bonus award associated with the randomly assigned Laugh-O-Metervalue.

17. The gaming device of claim 1, wherein the gaming unit is configured to permit the player to wager a bonus award for a double or nothing payout.

18. The gaming device of claim 1, wherein the at least one element comprises at least one credit, and the gaming unit is configured to permit cashing out of the at least one credit by the player in lieu of enabling the bonus game.

19. The gaming device of claim 18, wherein the gaming unit is configured to permit accumulation of a plurality of credits and to cash out at least some of the plurality of credits by the player in lieu of enabling the bonus game.

20. A gaming device for playing games of chance, comprising:

a gaming unit configured for operation in a first mode for play of a primary game and in a second mode for play of a bonus game;

wherein the gaming unit when enabled in the first mode is operable to randomly generate and display at least one combination of symbols selected from a plurality of symbols during play of the primary game, at least some combinations of symbols comprising winning outcomes for the primary game and at least one outcome of the primary game comprising at least one element to enable operation of the gaming unit in the second mode for play of a bonus game;

wherein the gaming unit when enabled in the second mode is operable to communicate with a player to provide the player with an opportunity to play one of a plurality of bonus games, each configured as a telephone call event and to make and communicate a choice of the one bonus game to the gaming unit, and to communicate at least one message associated with the chosen bonus game to the player through a phone link and to randomly generate an outcome for the chosen bonus game.

21. The gaming device of claim 20, wherein each of the telephone call events is associated with a fictitious telephone number.

22. The gaming device of claim 21, wherein the gaming unit is configured to receive a choice of telephone call event responsive to the player selecting one of the fictitious telephone numbers.

23. The gaming device of claim 22, wherein the gaming unit is configured to randomly communicate at least one of a plurality of potential messages for each telephone call event responsive to selection thereof by the player.

24. The gaming device of claim 22, wherein the gaming unit is configured for selection of one of the fictitious telephone numbers through a speed dial input.

25. The gaming device of claim 20, wherein the gaming unit is configured to prompt an input from the player responsive to the at least one communicated message and to randomly generate the outcome for the chosen bonus game in response to the player input.

26. The gaming device of claim 20, wherein the gaming unit is configured to provide the opportunity to the player to choose one of the plurality of bonus games in the form of a voice mail prompt delivered over the phone link.

27. The gaming device of claim 20, wherein the at least one outcome of the primary game comprising at least one element enables immediate operation of the gaming unit in the second mode for play of the bonus game.

28. The gaming device of claim 27, wherein the at least one element comprises a watermark associated with at least one symbol of a randomly generated and displayed combination of symbols.

29. The gaming device of claim 20, wherein the at least one element comprises at least one credit for enabling operation of the gaming unit in the second mode for play of the bonus game at the player's discretion.

30. The gaming device of claim 20, wherein the gaming unit is configured to permit accumulation of a plurality of credits for enabling operation of the gaming unit in the second mode for play of the bonus game at the player's discretion.

31. The gaming device of claim 30, wherein the gaming unit is configured to permit tendering of at least two different numbers of credits for play of the bonus game for at least two different bonus awards.

32. The gaming device of claim 30, wherein the gaming unit is configured to permit tendering of differing numbers of credits, each of the two differing numbers of credits being within at least two different, non-overlapping ranges, for play of the bonus game for bonus awards within at least two different ranges of bonus awards, each of the at least two different ranges of bonus awards being non-overlapping.

33. The gaming device of claim 20, wherein the gaming unit is configured to permit the player to wager a bonus award for a double or nothing payout.

34. The gaming device of claim 20, wherein the at least one element comprises at least one credit, and the gaming unit is configured to permit cashing out of the at least one credit by the player in lieu of enabling the bonus game.

35. The gaming device of claim 34, wherein the gaming unit is configured to permit accumulation of a plurality of credits and to cash out at least some of the plurality of credits by the player in lieu of enabling the bonus game.

36. A method of playing a game of chance, comprising:

randomly generating and displaying at least one combination of symbols selected from a plurality of symbols during play of a primary game, at least some combinations of symbols comprising winning outcomes, for the primary game and at least one outcome of the primary game comprising at least one element to enable play of a bonus game;

in association with play of a bonus game, providing the player with an opportunity to play one of a plurality of bonus games and to make at least two choices associated with play of the one bonus game, each of the at least two choices being available from a plurality of choices, and randomly generating an outcome for the bonus game subsequent to the making of the at least two choices;

further including configuring each of the plurality of bonus games as a simulation of a telephone call event and communicating with the player in association with play of each bonus game of the plurality through a phone link.

37. The method of claim 36, wherein the at least one outcome of the primary game comprising at least one element enables immediate play of the bonus game.

38. The method of claim 37, wherein the at least one element comprises a watermark associated with at least one symbol of a randomly generated and displayed combination of symbols.

39. The method of claim 36, wherein the at least one element comprises at least one credit for enabling play of the bonus game at the player's discretion.

40. The method of claim 36, further including permitting accumulation of a plurality of credits for enabling play of the bonus game at the player's discretion.

41. The method of claim 40, further including permitting tendering of at least two different numbers of credits for play of the bonus game for at least two different bonus awards.

42. The method of claim 40, further including permitting tendering of differing numbers of credits, each of the differing numbers of credits being within at least two different, non-overlapping ranges, for play of the bonus game for bonus awards within at least two different ranges of bonus awards, each of the at least two different ranges of bonus awards being non-overlapping.

43. The method of claim 36, further including initiating communication with the player relating to a bonus game through the phone link.

44. The method of claim 43, further including permitting the player to choose one bonus game of the plurality for play.

45. The method of claim 43, further comprising randomly assigning one of the bonus games of the plurality for play.

46. The method of claim 36, wherein each simulation of a telephone call event presents the player with the at least two choices, and further comprising enabling the player to manually input each of the at least two choices.

47. The method of claim 46, wherein at least one of the plurality of bonus games is configured as a Radio Call-In telephone call event, a Psychic Hotline telephone call event, a Love Line telephone call event, or a Joke Line telephone call event.

48. The method of claim 47, wherein the Radio Call-In telephone call event is configured to operate in a manner comprising:

providing a choice to the player of a plurality of radio stations, each exhibiting a different program format;

responsive to a choice of a radio station from the plurality, randomly assigning a contest category from a plurality of contest categories;

randomly providing a question within the assigned contest category from a plurality of questions;

providing a choice to the player of a plurality of characters to answer the provided question;

responsive to a choice of character, initiating an answer to the provided question by the character; and randomly generating a bonus award.

49. The method of claim 47, wherein the Psychic Hotline telephone call event is configured to operate in a manner comprising:

providing a choice to the player of a plurality of different questions for a reading by a psychic;

responsive to the choice of a question from the plurality, providing a choice to the player of a plurality of different methods for the reading;

responsive to the choice of a reading method, providing a reading responsive to the chosen question; and randomly generating a bonus award.

50. The method of claim 47, wherein the Love Line telephone call event is configured to operate in a manner comprising:

providing to the player a choice of gender for a love interest;

responsive to the choice of a gender by the player, providing the player with a choice of personal profiles each exhibiting at least some different characteristics;

responsive to the choice of a personal profile by the player, matching the player with a love interest in relation to the exhibited characteristics of the chosen personal profile; and randomly generating a bonus award.

51. The method of claim 47, wherein the Joke Line telephone call event is configured to operate in a manner comprising:

providing to the player a plurality of joke categories from which to choose;

responsive to the choice of a joke category from the plurality by the player, providing an initial portion of a joke and providing to the player a plurality of concluding portions for the joke from which to choose;

responsive to the choice of a concluding portion for the joke by the player, playing back the joke as completed with the chosen concluding portion;

randomly assigning a Laugh-O-Meter value to the completed joke; and generating a bonus award associated with the randomly assigned Laugh-O-Metervalue.

52. The method of claim 36, further comprising permitting the player to wager a bonus award for a double or nothing payout.

53. The method of claim 36, wherein the at least one element comprises at least one credit, and further comprising permitting cashing out of the at least one credit by the player in lieu of enabling the bonus game.

54. The method of claim 53, further comprising permitting accumulation of a plurality of credits and cashing out at least some of the plurality of credits by the player in lieu of enabling the bonus game.

55. A method for playing games of chance, comprising:

randomly generating and displaying at least one combination of symbols selected from a plurality of symbols during play of a primary game, at least some combinations of symbols comprising winning outcomes for the primary game and at least one outcome of the primary game comprising at least one element to enable play of a bonus game;

in association with play of a bonus game, communicating with a player to provide the player with an opportunity to play one of a plurality of bonus games, each configured as a telephone call event, and to make a choice of the one bonus game, to communicate at least one message associated with the chosen bonus game to the player through a phone link and to randomly generate an outcome for the bonus game.

56. The method of claim 55, further including associating each of the telephone call events with a fictitious telephone number.

57. The method of claim 56, further including receiving a choice of telephone call event responsive to the player selecting one of the fictitious telephone numbers.

58. The method of claim 57, further including randomly communicating at least one of a plurality of potential messages for each telephone call event responsive to selection thereof by the player.

59. The method of claim 56, further comprising enabling selection of one of the fictitious telephone numbers through a speed dial input.

60. The method of claim 55, further comprising prompting an input from the player responsive to the at least one communicated message and randomly generating the outcome for the bonus game in response to the player input.

61. The method of claim 55, further including providing the opportunity to the player to choose one of the plurality of bonus games in the form of a voice mail prompt delivered over the phone link.

62. The method of claim 55, further comprising immediately enabling play of the bonus game responsive to the at least one outcome of the primary game comprising at least one element.

63. The method of claim 62, wherein the at least one element comprises a watermark associated with at least one symbol of a randomly generated and displayed combination of symbols.

64. The method of claim 55, wherein the at least one element comprises at least one credit for enabling play of the bonus game at the player's discretion.

65. The method of claim 55, further including permitting accumulation of a plurality of credits for enabling play of the bonus game at the player's discretion.

66. The method of claim 65, further comprising permitting tendering of at least two different numbers of credits for play of the bonus game for at least two different bonus awards.

67. The method of claim 65, further comprising permitting tendering of differing numbers of credits, each of the two differing numbers of credits being within at least two different, non-overlapping ranges, for play of the bonus game for bonus awards within at least two different ranges of bonus awards, each of the at least two different ranges of bonus awards being non-overlapping.

68. The method of claim 55, further comprising permitting the player to wager abonus award for a double or nothing payout.

69. The method of claim 55, wherein the at least one element comprises at least one credit, and further comprising permitting cashing out of the at least one credit by the player in lieu of enabling the bonus game.

70. The method of claim 69, further comprising permitting accumulation of a plurality of credits and cashing out at least some of the plurality of credits by the player in lieu of enabling the bonus game.

71. A method of playing a game of chance, comprising:

randomly generating and displaying at least one combination of symbols selected from a plurality of symbols during play of a primary game, at least some combinations of symbols comprising winning outcomes for the primary game and at least one outcome of the primary game comprising at least one element to enable play of a bonus game;

in association with play of a bonus game, providing a player with an opportunity to guess at least some unknown digits of a predetermined multi-digit number configured as a telephone number, the process for guessing each of the at least some unknown digits being configured to confirm a correct guess of an unknown digit and to advise if an incorrect guess of an unknown digit is higher or lower than the unknown digit;

proceeding through at least one guess of each unknown digit until the telephone number is completed; and awarding a bonus amount when the telephone number is completed.

72. The method of claim 71, further comprising providing the player with an opportunity to guess all digits of the telephone number.

73. The method of claim 71, further comprising requiring the player to place a telephone call to the completed telephone number to trigger at least some portion of the bonus amount award.

74. The method of claim 71, further comprising providing the player with at least one wild symbol to use as a digit to complete the telephone number.

75. The method of claim 71, further comprising correlating the bonus amount to a number of guesses required to complete the telephone number.

* * * * *

UNITED STATES PATENT AND TRADEMARK OFFICE

CERTIFICATE OF CORRECTION

PATENT NO. : 6,575,829 B2 
DATED : June 10, 2003
INVENTOR(S) : James M. Coleman et al.

It is certified that error appears in the above-identified patent and that said Letters Patent is hereby corrected as shown below:

Column 14,
Line 67, cancel "winning outcomes, for" and insert -- winning outcomes for --

Signed and Sealed this

Twenty-third Day of September, 2003

JAMES E. ROGAN
*Director of the United States Patent and Trademark Office*